United States Patent [19]

Gehly et al.

[11] Patent Number: 5,001,616

[45] Date of Patent: Mar. 19, 1991

[54] OPTICAL SYSTEM FOR LIGHTING FIXTURE

[75] Inventors: Joel C. Gehly, McKean, Pa.; A. Michael Smith, LaFayette, Colo.

[73] Assignee: American Sterilizer Company, Erie, Pa.

[21] Appl. No.: 495,254

[22] Filed: Mar. 16, 1990

[51] Int. Cl.[5] ..... F21V 7/00

[52] U.S. Cl. ..... 362/308; 362/804; 362/332; 362/339; 362/293; 128/23

[58] Field of Search ..... 362/308, 309, 310, 293, 362/296, 297, 298, 299, 277, 282, 283, 326–328, 339, 804, 332; 350/286, 431, 448, 482, 483; 128/22, 23

[56] References Cited

U.S. PATENT DOCUMENTS

| | | | |
|---|---|---|---|
| 2,495,320 | 1/1950 | Franck | 362/309 |
| 4,135,231 | 1/1979 | Fisher | 362/269 |
| 4,292,664 | 9/1981 | Mack | 362/293 |
| 4,380,794 | 4/1983 | Lawson | 362/804 |
| 4,755,916 | 7/1988 | Collins | 362/298 |
| 4,937,715 | 6/1990 | O'Shea et al. | 362/268 |

*Primary Examiner*—Stephen F. Husar
*Assistant Examiner*—D. M. Cox
*Attorney, Agent, or Firm*—Kirkpatrick & Lockhart

[57] ABSTRACT

A lighting fixture to illuminate a target surface, particulary a surgical site, is provided which includes a light source, a reflector superposing and partially circumscribing the light source, a cylindrical filter surrounding the light source coaxial to the axis of symmetry of the lighting fixture and a refractor positioned beneath the reflector through which the light reflected from the reflector must pass to reach the target surface. The refractor is divided into a plurality of portions which radiate outwardly from the axis of symmetry. Each portion includes first, second and third prism means having individual prism members of varying configuration for focusing the light to first, second and third areas, respectively, within a cylinder of light defined by the light passing through the refractor, to provide small, medium and large patterns respectively, of the cylinder of light when it impinges upon the target surface. Means are provided for selectively blocking light from passing through certain areas of the refractor to achieve the desired pattern.

32 Claims, 5 Drawing Sheets

OPTICAL SYSTEM FOR LIGHTING FIXTURE

BACKGROUND OF THE INVENTION

1. Field of the Invention

The present invention relates to lighting apparatus, and more particularly to lighting apparatus having means for controlling the pattern and intensity of the emitted light.

2. Description of the Prior Art

Prior approaches to improving surgical lighting have generally relied on increasing the size of the lighting fixture or the number of light sources. For example, Herold, U.S. Pat. No. 3,927,313 discloses a surgical lighting fixture having several individual light sources evenly arranged around a central axis. A problem with conventional multiple source lightheads however, is that they produce multiple shadows when the beams are interrupted.

Efforts to reduce shadow formation have been made. Brendgord et al., U.S. Pat. No. 4,037,096 which issued on July 19, 1977, discloses a single source lighthead used with a multiple reflector optical system. The light rays are directed by means of the multiple reflectors to approach the illuminated area in an angled relationship relative to the axis of symmetry of the lighting apparatus, rather than parallel to the axis. Because the light rays approach objects from all angles, they tend to travel around the object, thus, reducing shadow formation on the desired area.

Gehly et al., U.S. Pat. No. 4,651,257 issued on Mar. 17, 1987 discloses a multiple lighting apparatus designed to reduce shadows while providing a large field of intense illumination. The light rays projected from the reflector converge at an acute angle relative to the axis of symmetry of the lighting apparatus, crossing that axis, to produce a single beam.

Single source lightheads eliminate the problem of multiple shadows but have not heretofore provided both high intensity and a large pattern of illumination. To achieve the desired intensity, the pattern of illumination must be limited or the wattage of the bulb increased. The achieve a large pattern, the intensity is reduced. Single source surgical lightheads generally offer their best characteristics at a pattern no greater than six inches and an intensity no greater than 6,000 foot candles.

In some applications, for example cardiovascular surgery, a larger pattern of illumination is preferred. In Europe, the trend is to couple larger surgical lights to provide a larger illumination pattern with a smaller light of greater intensity to pinpoint a critical area.

In the specialized lighting utilized for surgical procedures, it is frequently desirable to be able to adjust the pattern size of the light pattern on the wound site depending upon the particular procedure being used and/or the progress of the operation during the surgical procedure.

The conventional means of accomplishing a change in focus and/or a change in pattern size is by mechanical movement of the bulb relative to the reflector or reflectors of the optical system. This normally involves utilization of a lever or levers located on the light itself in order to initiate physical lamp source displacement. Fischer et al., U.S. Pat. No. 4,288,844, issued on Sept. 8, 1981 discloses a means for controlling pattern size and/or focus of surgical lighting. Several commercially available lighting fixtures provide some adjustability by means of altering the position of the entire lighting fixture relative to the work surface or by means of complicated light source positioning.

Gehly et al., U.S. Pat. No. 4,617,619 issued on Oct. 14, 1986 describes a lighting apparatus having a multiple reflector system which permits the pattern and intensity of illumination to be adjusted by rotation of one of the reflectors.

Refractive lenses or filters for focusing light emitted from a lighting apparatus are available. Greppin U.S. Pat. No. 2,280,402 issued on Apr. 21, 1942 describes a dental lamp having a filter with multiple diffusing ribs for spreading the light laterally relative to the optical axis. Gulliksen, U.S. Pat. No. 4,207,607 issued on June 10, 1980 describes a lighting apparatus having a filter with varying zones for controlling or not controlling the direction of the light emitted from the apparatus.

An object of the present invention is to provide a lighting fixture having a sufficient peak illuminance and a useful uniform pattern size to be useful for surgical procedures. It is a further object to the present invention to provide a lighting fixture which eliminates the need for refocusing or repositioning the lighthead when the pattern size is changed. Finally, it is yet another object of the invention to provide a lighting fixture which will produce a variety of pattern sizes without sacrificing other optical characteristics of peak illuminance and depth of field.

SUMMARY OF THE INVENTION

The objects of the present invention are satisfied by a lighting fixture to illuminate a target surface which includes a light source means for emitting light and reflector means superposing the light source means in a partially circumscribing radially spaced relationship about an axis of symmetry of the lighting fixture for receiving the light emitted from the light source means and directing such received light away from the reflector means toward a target surface. The lighting fixture also includes refractor means positioned beneath the reflector means through which the light directed away from the reflector means passes before proceeding towards the target surface. The refractor means is comprised of a plurality of at least first and second refractive prism means. The plurality of first prism means are configured to focus the light to define a cylinder of light coaxial to the axis of symmetry having a first desired diameter and extending for a length within the total depth of field. The plurality of second prism means are configured to focus the light to increase the outer diameter of the cylinder of light to a second desired diameter without altering the illuminance intensity and without significantly changing the length of the cylinder of light, wherein the light is directed away from the reflector means and passes through the first and second prism means in such a manner that the light defining the first and second diameters of the cylinder of light does not cross the axis of symmetry.

The lighting fixture preferably also includes a plurality of third prism means being configured to focus the light to increase the outer diameter of the cylinder of light, relative to the second desired diameter, to a third desired diameter without altering the illuminance intensity and without significantly changing the length of the cylinder of light. The light is directed away from the reflector means and passes through the third prism means in such a manner that the light defining the third desired diameter of the cylinder of light does not cross the axis of symmetry of the lighting fixture.

The refractor means is preferably divided into a plurality, preferably eight, of substantially equal adjacent portions which radiate outwardly from the axis of symmetry. Each portion is comprised of at least the first and second prism means and preferable, the first, second and third prism means, such that light passing through the plurality of first, second and third prism means of the plurality of portions is mixed to achieve a blended pattern of light when the cylinder of light impinges the target surface. The plurality of first, second and third prism means are positioned in predetermined areas of each portion of the refractive means to specifically focus the light flux passing therethrough to specific areas within the first, second and third diameters, respectively, of the cylinder of light. The first prism means may be comprised of a plurality of different segments, each of which focuses the light flux to a different area within the first desired diameter of the cylinder of light. Each of the first, second and third prism means, including the plurality of different segments of the first prism means, is preferably comprised of a plurality of individual prism members of varying configurations.

The lighting fixture may also include means for selectively blocking the passage of light through the refractor means. The blocking means is movable in gradual degrees to a first position in which the light passing through the first, second and third prism means is not blocked to permit the cylinder of light to assume the third desired diameter and is movable in gradual degrees to a second position in which the light passing through the third prism means is gradually blocked to gradually reduced the diameter of the cylinder of light from the third desired diameter to confine the cylinder of light to the second desired diameter and is movable in gradual degrees to a third position in which the light flux passing through the second and third prism means is gradually blocked to gradually reduced the diameter of the cylinder of light from the second desired diameter to confine the cylinder of light to the first desired diameter The lighting fixture also preferably includes a cylindrical filter arranged circumferentially around the light source means, coaxial to the axis of symmetry, through which the light from the light source means passes to the reflector means. The cylindrical filter may be made of a heat absorbing material and may be coated with a dichroic coating to further absorb the heat emitted from the light source means.

BRIEF DESCRIPTION OF THE DRAWINGS

In order that the present invention may be easily understood and readily practiced, a preferred embodiment will now be described by way of example only, in conjunction with the following figures wherein.

DETAILED DESCRIPTION OF THE PREFERRED EMBODIMENTS

Figure 1:
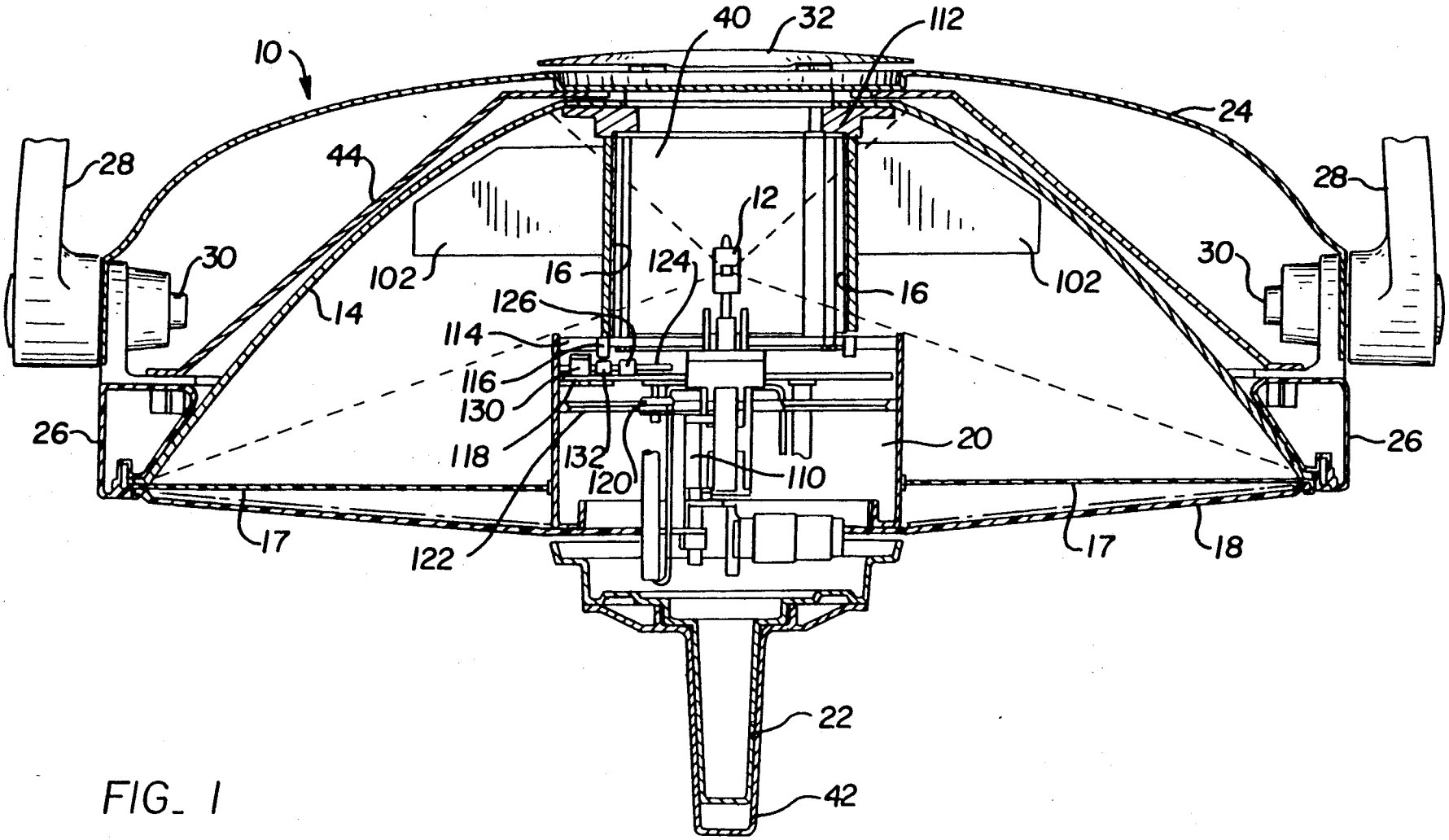
FIG. 1 is a front elevation section view of a preferred embodiment of the lighting fixture of the present invention.

FIGS. 1–9 illustrate the preferred embodiment of the lighting fixture 10 of the present invention. Lighting fixture 10 includes generally an optical core 40 which houses a light source means, or lamp 12, a reflector 14, a cylindrical filter 16, a refractor 18, a center core 20 for housing control mechanisms and a handle 22.

A reusable, removable sterilizable handle cover 42, preferable made of plastic such as polyetherimide, sold under the trademark Ultem® by GE Plastics, is provided to slide over handle 22. A light fixture housing 24 preferably made of hydroformed aluminum, is provided to protect and cover the reflector 14 and the light fixture's electronics. A blow molded plastic structural ring provides a bottom support 26 for holding the edges of the reflector 14 and refractor 18. A brace member 44 joins housing 24, bottom support 26 and reflector 14. A support 28, preferable made of structural aluminum, connects the lighting fixture 10 to a suspension system (not shown). The lighting fixture 10 pivots about the horizontal axis between bolts 30 of each support 28. An easily removable cap assembly 32 is provided to permit access to the optical core 40 for cleaning and servicing filter 16 and lamp 12.

Filter 16 is preferably a simple clear glass filter made of a borosilicate type glass. Alternatively, filter 16 may be a coated glass filter designed to remove unwanted infrared, or heat, energy in the near and far IR spectrum (760–2000 mm) from the light spectrum. Any suitable heat absorbing glass may be used, such as glass sold under the name Schott-KG-1. The filter may be made of four equal arcuate sections or one continuous cylindrical member. Each filter section is formed by slumping a polished sheet of glass into a suitable mold and then trimming the edges. The interior surface of cylinder 16 may be coated with a hot mirror type, thin-film dichroic coating. A suitable coating would be one having a sharp cut-off of the near infrared energy about (700 nm) to further eliminate unwanted heat energy from the light output. Cylindrical filter 16 is open at its upper end to permit air flow up through the center core 20 and the optical core 40 to aid in eliminating the collected heat from the lamp 12. Care must be taken that too much heat is not retained in the optical core 40.

Reflector 14 superposes and partially circumscribes lamp 12. It is designed to collect the light from lamp 12 and direct it in a substantially collimated manner onto refractor 18. A preferred embodiment of reflector 14 for surgical use has about a 22 ¼" diameter and 7 ¼" height. The reflector 14 is preferably made of an injection molded plastic, such as a high temperature polycarbonate. It is a generally parabolic member which partially circumscribes, and is radially spaced from, lamp 12 and the axis of symmetry of lighting fixture 10. The reflector 14 is coated on its interior surface with a color correcting cold mirror dichroic film which reflects visible energy onto the refractor 18 and selectively absorbs/-transmits part of the visible light spectrum through the coating and reflector 18 to change the color temperature of the light, preferably from about 3250° K. to approximately 4200° K. IR energy (700–2000 nm) is transmitted through the coating and the clear plastic reflector to the housing 24 to more adequately manage the thermal conditions inside the light fixture 10. An additional filter element 17 made of a clear, thin polycarbonate plastic and coated with a hot mirror type coating is preferably provided to further reduce the IR energy leaving the lighting fixtures. This IR energy is directed back to the reflector 18 and then on through to the housing 24.

Figure 4:
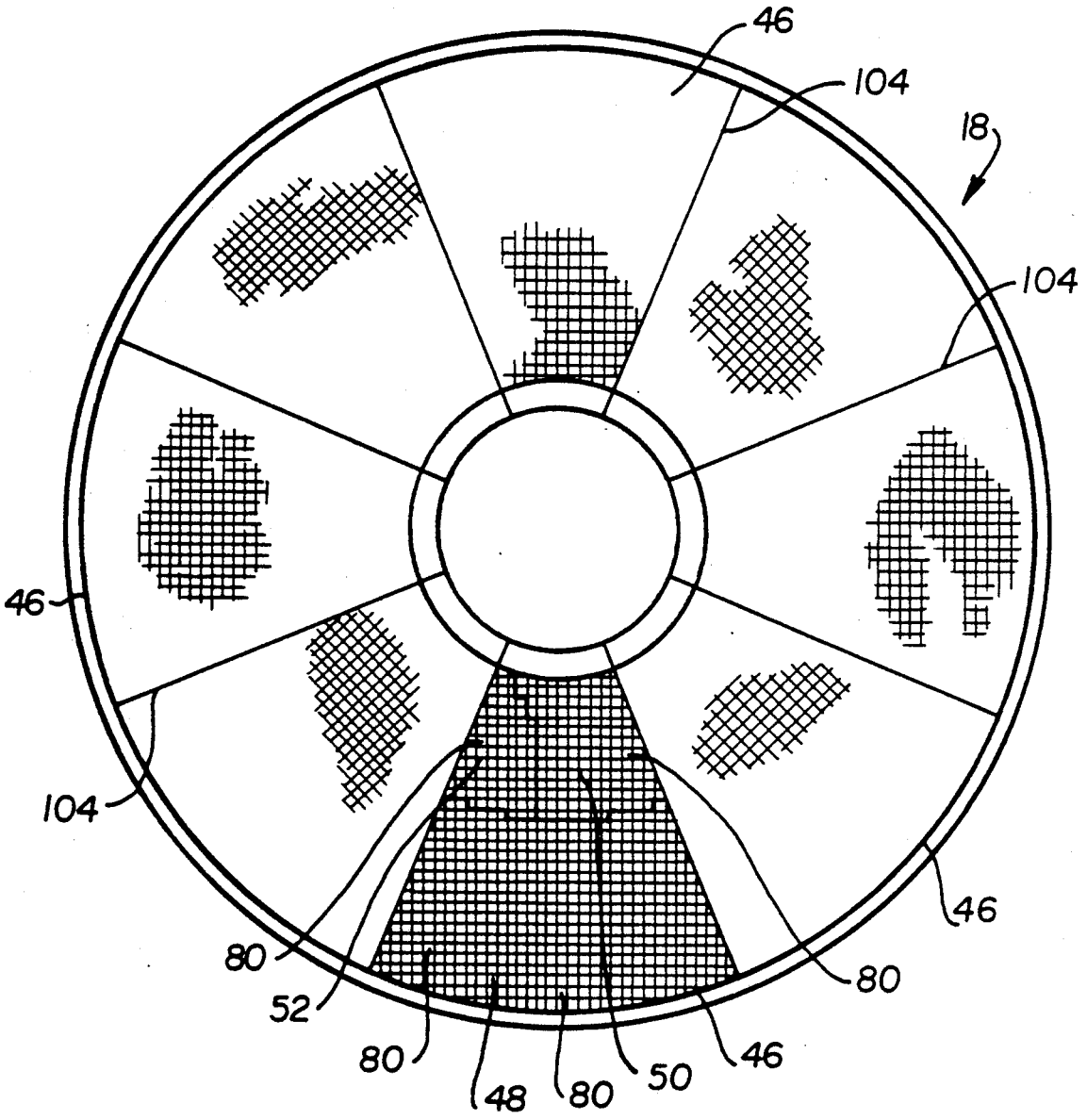
FIG. 4 is a plan view of the preferred embodiment of the refractor means of the lighting fixture of FIG. 1.

Refractor 18, as shown in FIG. 4, is divided into eight equal adjacent, preferably wedge-shaped, portions 46 which radiate outwardly relative to the axis of symmetry of the lighting fixture 10. Each portion 46 is optically identical to each of the other portions 46.

Figure 9:
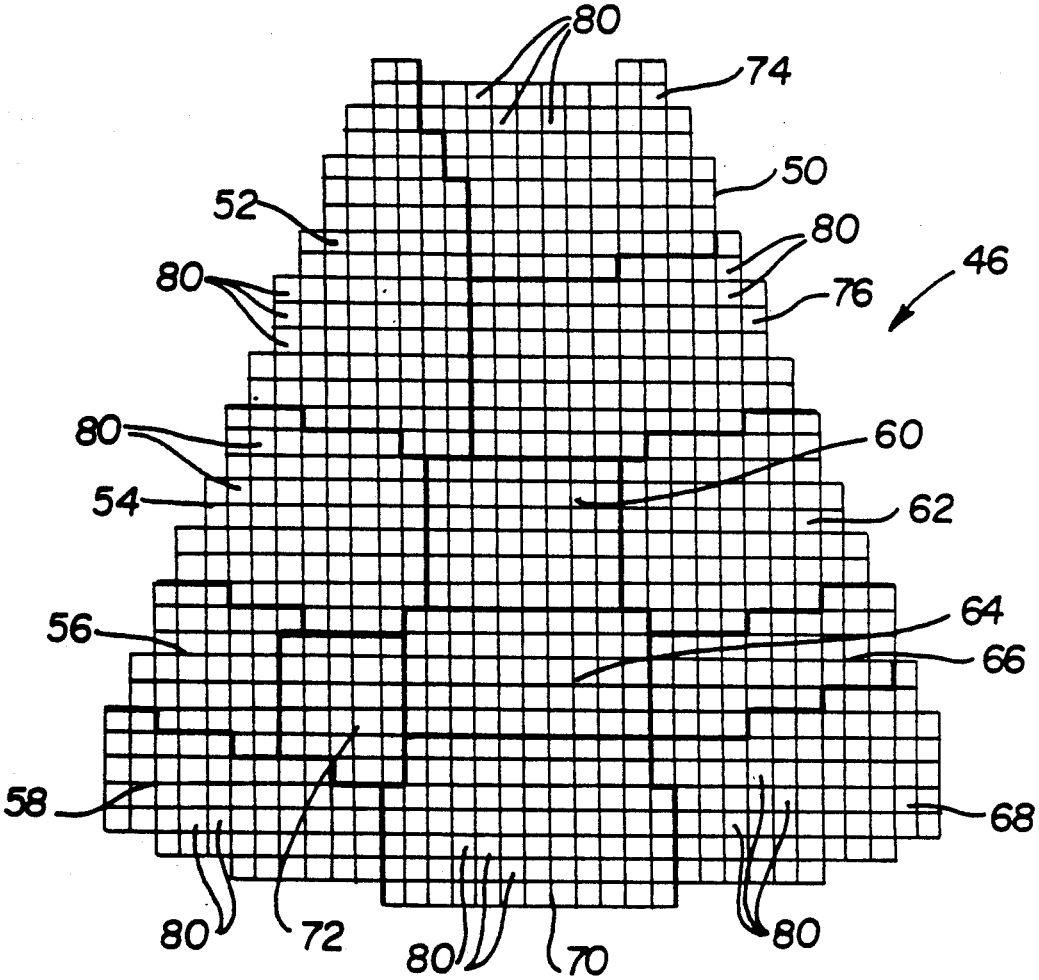
FIG. 9 is a diagrammatic view of small, medium and large pattern areas of the prisms of one wedge-shaped portion of the refractor of FIG. 4, including ten segments of prisms within the small pattern area.

Referring to FIGS. 4 and 9, each portion 46 includes a first set of refractive prisms 48 for providing a small pattern of light on a target surface, a second set of refractive prisms 50 for providing a medium pattern of light on a target surface and a third set of refractive prisms 52 for providing a large pattern of light on a target surface. The first set of prisms 48 is further divided into a plurality of, preferably ten, different segments 54, 56, 58, 60, 64, 66, 68, 70, 72, each of which is further divided into a plurality of individual prism members 80. The second set of prisms 50 is further divided into at least two different segments 74 and 76. Each segment 74, 76 is further divided into individual prism members 80. The third set of prisms is similarly divided into a plurality of individual prism members 80. In the preferred embodiment of refractor 18, there are 806 individual prisms 80 in each portion 46. Each prism member 80 is preferably approximately ¼ inch square with an inclining top. The angle of inclination of the tops of prism members 80 vary to bend the light passing through such prism member to a desired degree.

Figure 2:
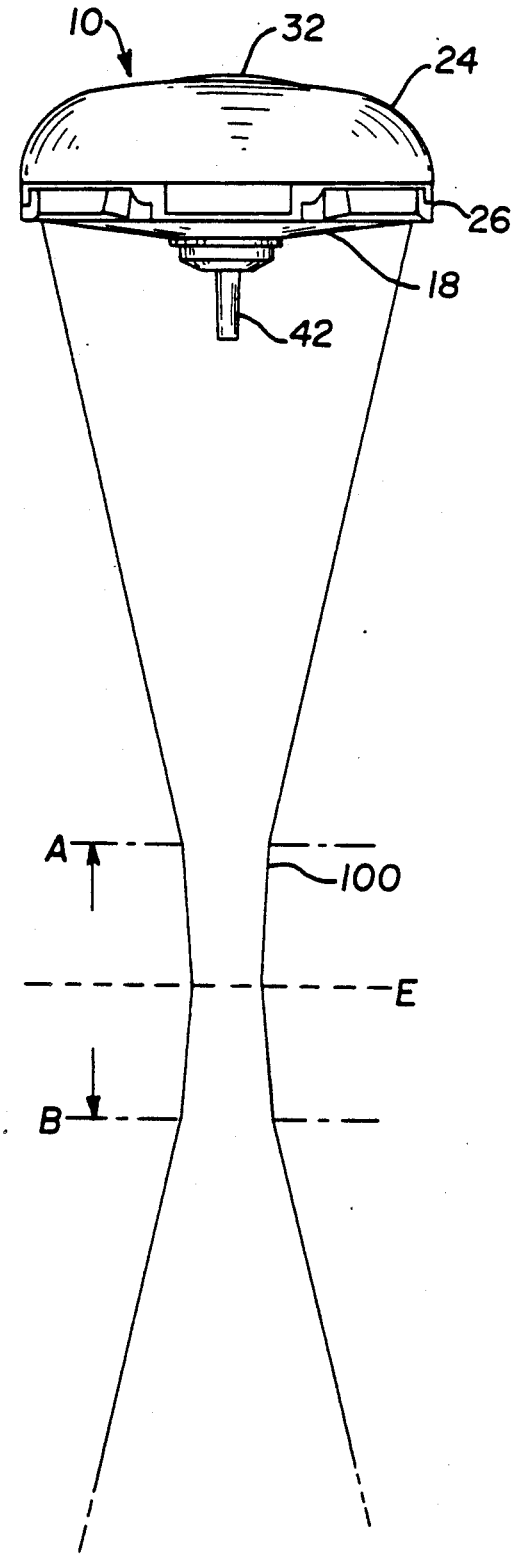
FIG. 2 is a view of one pattern of light emitted by the lighting fixture of FIG. 1.
Figure 3:
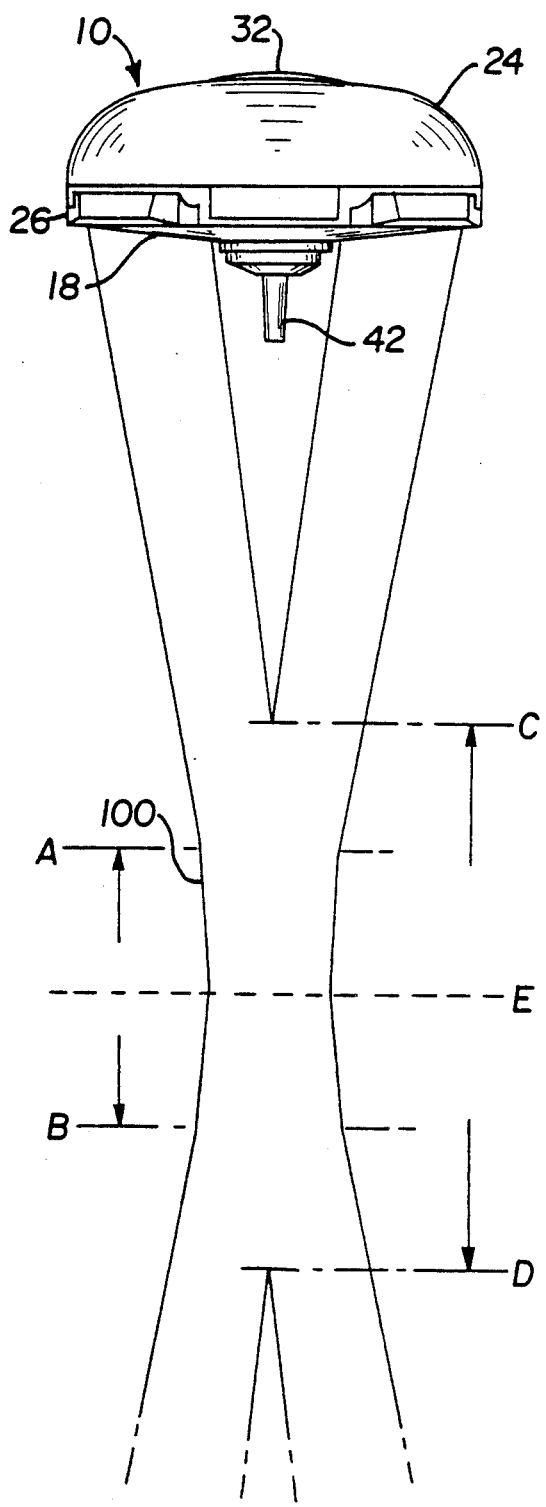
FIG. 3 is a view of another pattern of light emitted by the lighting fixture of FIG. 1.

Each set of prisms, 48, 50 and 52, and each segment within a set of prisms, 54–76, specifically directs the light to specific areas within a cylinder of light 100 defined by the light emitted from lighting fixture 10. The cylinder of light 100 is relatively long (16–18 inches) in the preferred embodiment of lighting fixture 10, starting at a distance of about 36 inches from refractor 18. The cross section of the areas within the cylinder of light 100 define small, medium and large pattern sizes, preferably about 4, 6 and 8 inches in diameter, respectively. Referring to FIGS. 2 and 3, the cylinder of light 100 is of slightly varying cross section throughout its length. The term "cylinder of light," as used herein, will refer to a cylinder of the type generally shown in the drawings wherein the diameter throughout the length of the cylinder varies by about ±10%. FIG. 2 shows the small pattern projection of light. FIG. 3 shows the medium pattern projection of light. The length of the cylinder of light 100 is substantially constant from pattern to pattern as shown by the distances indicated between lines A and B in FIGS. 2 and 3. The cylinder of light 100 lies within the total depth of field of the optical system, shown in FIG. 3 as the distance between lines C and D. The depth of field is the total distance where there is a useful light pattern without a dark hole developing in the pattern. It ranges from 21–24 inches in length in the preferred embodiment of the lighting fixture 10. The focal plane, indicated at line E, corresponds to the preferred location of the target surface. The target surface may be any work surface, such as a surgical site, and is preferably about 44 inches from refractor 18.

Figure 8:
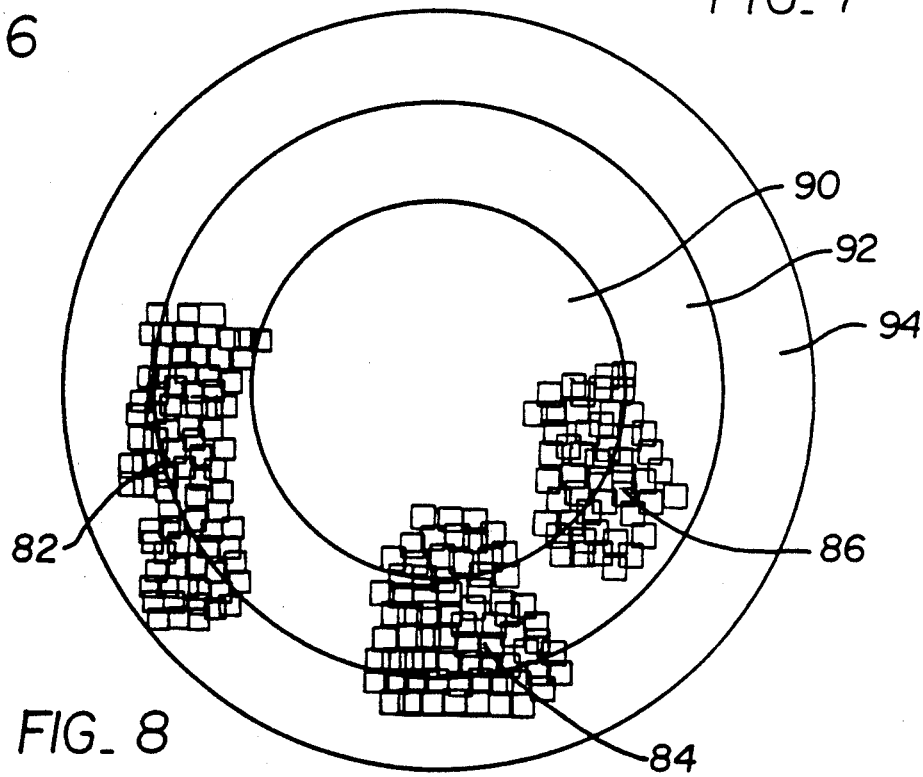
FIG. 8 is a view of the areas of impingement on a target surface of light passed through various areas of the refractor of FIG. 4.

Referring to FIG. 8, the three pattern sizes are shown in cross section as they would impinge the target surface by first, second and third diameters 90, 92 and 94 of the cylinder of light 100. The overlapping square section areas 82 correspond to light focused onto the target surface by one third prism set 52 of one portion 46 when the target surface is about 44 inches from the refractor 18. The overlapping square section areas 84 and 86 correspond to light focused onto the target surface at the same target distance by segments 74 and 76, respectively, of one second prism set 50 of one portion 46. Similar square section areas (not shown) corresponding to light flux focused onto the target surface within the first, or small diameter 90 of the cylinder of light 100 would also occur. When similar areas of impinging light are superimposed on the target surface for each of the eight portions 46 of refractor 18, a smooth blended pattern of light is provided.

Referring to FIGS. 4 and 9, the small pattern area defined by first prism set 48 is located at the extreme outer area of refractor 18. This arrangement gives the maximum possible shadow reduction performance for any of the three patterns. The second and third prism sets 50 and 52, for the medium and large patterns, respectively, are designed to simply add light flux to the small pattern's outer diameter 90 to increase the size of the pattern as shown in FIG. 8 to diameters 92 and 94. The increase in pattern size is achieved without significantly altering the center peak illuminance. The individual prism design of refractor 18 allows light flux to be directed to the target surface without crossing the axis of symmetry of lighting fixture 10, which is significant in that it permits consistent peak illuminance, or light intensity, throughout the cylinder of light 100 independent of pattern size.

The complicated multiple prism system has the benefit of allowing precise and accurate direction of specific amounts of light to make up the light field at the target distance. The radial illuminance profile of light from the reflector 14 can be predicted and measured by suitable know means, such as an illuminance meter to benefit the design direction of specific prism areas to produce the desired light field size and flux profile. Additionally, the individual prism design concept of the present invention allows light flux to be directed to the target surface without crossing the axis of symmetry of the lighting fixture. This important and unique design feature enables the lighting fixture 10 to achieve the extremely unique performance characteristics of the long cylinder of light 100. Designing the refractor 18 into eight wedges insures the adequate mixing of prism areas at the target distances to achieve a smooth, blended pattern.

The cylinder of light 100 remains at the desired distance from the lighting fixture in all three pattern sizes. In each pattern size, the peak illuminance remains constant. Also, as shown in FIGS. 2 and 3, in the total cylinder top to bottom, the peak illuminance remains relatively constant (±10%) for each pattern size. This extremely unique performance permits initial positioning of the lighting fixture 10 without any further movement needed for refocusing or adjustment during use to find the optimum area of light output from lighting fixture 10.

In prior art devices, outside of the extreme top and bottom area of the cylinder, the light field in the depth of field will start to grow in diameter and the peak illuminance decrease. In the design of the present invention, the extremely large depth of field simply adds to the useful area of light flux produced and reduces the need to refocus the lighting fixture 10.

The design of the optical system of lighting fixture 10 produces maximum shadow reduction while maintaining maximum cavity penetration. The ability of the individual prisms 80 of first prism set 48 precisely aim the light so that large sections of light do not cross the axis of symmetry of light fixture 10 is the key to achieving both of these features.

Lamp 12 is positioned at the focal point of reflector 14. Lamp 12 is preferably a 22 volt, 220 watt tungsten-halogen lamp which produces an average of 6400 lumens. When the height of reflector 14 is about 7 ¼ inches and the diameter about 22 ¼ inches, approximately 55% of the total lamp lumens are collected.

Figure 5:
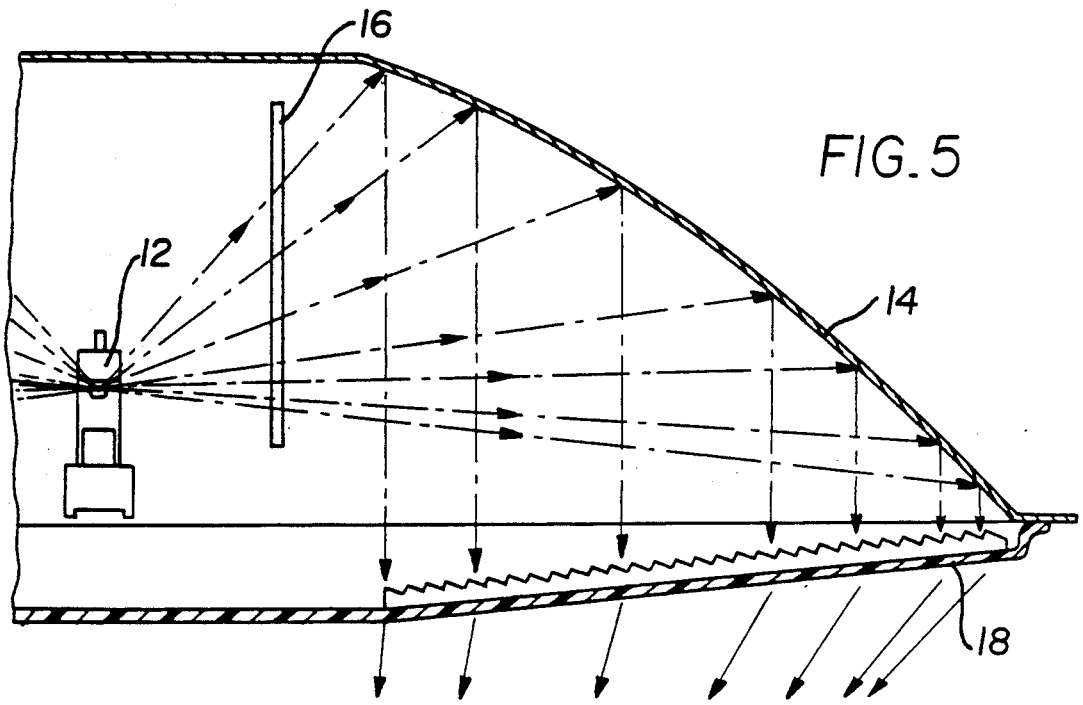
FIG. 5 is a partial section view of the flow of light from the light source, through a cylindrical filter, to a reflector and through the refractor of FIG. 4.
Figure 6:
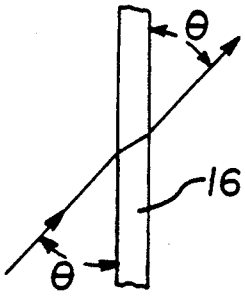
FIG. 6 is a view of the flow of light passing through the filter of FIG. 5.
Figure 7:
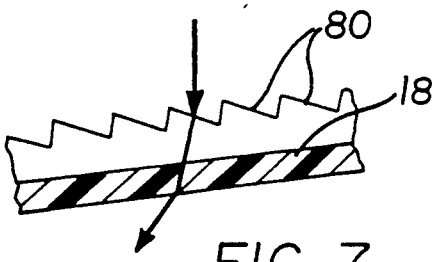
FIG. 7 is a view of the flow of light passing through an area of the refractor of FIG. 5.

Referring to FIG. 5, the light emitted from lamp 12 passes through filter 16 in the manner shown in FIG. 6 and is received by, or intersected by, reflector 14. When light passes through filter 16, heat energy is absorbed as described above. The reflector 14 collects the light from lamp 12 and directs it, preferably in a collimated manner, away from reflector 12 onto refractor 18 through which the light passes in the manner shown in FIG. 7 towards a target surface. The coating on reflector 18 changes the color temperature of the light as described above.

The collimated light from reflector 14 is intersected by refractor 18. The prism member 80 are of varying configuration from prism set to prism set and among the different segments within a prism set. As shown in FIG. 5, light passing through different areas of refractor 18 is focused at different angles so that the cylinder of light 100 shown in FIGS. 2 and 3, is produced. From the direction of the light rays shown in FIG. 5, it can be seen that the light does not cross the axis of symmetry of lighting fixture 10 as the light is directed away from the reflector 14 through refractor 18 to define the cylinder of light 100.

Means are provided in the form of blocking members, or flags 102 to selectively block the light from passing through areas of refractor 18 so that certain angles of light are selectively blocked from impinging upon the target surface. There are preferably eight flags 102 arranged to align when in a fully open position, with the line of intersection 104 of adjacent portions 46 of refractor 18. Flags 102 lie in planes which radiate from the axis of symmetry and pass through the lines of intersection 104 of adjacent portions 46. The flags 102 are movable in synchronization and, preferably in gradual degrees, to a first, fully open position as shown in FIG. 1, in which light passing through the first, second and third prism sets, 48, 50, 52, respectively, is not blocked to permit the cylinder of light 100 to assume the large pattern shown by diameter 94 in FIG. 8. The flags 102 are also movable, in synchronization and preferably in gradual degrees, to a second position in which light passing through the third set of prisms 52 is gradually blocked to gradually reduce the pattern on the target surface to medium as shown by diameter 92 in FIG. 8. The flags 102 are also movable, in synchronization and preferably in gradual degrees, to a third position in which the light passing through the second and third sets of prisms, 50 and 52, is gradually blocked to gradually reduce the pattern produced by the diameter of the cylinder of light 100 to the small pattern as shown by diameter 90 of FIG. 8.

The mechanism 110 for controlling the gradual movement of flags 102 among its first, second or third positions is housed in center core 20. The mechanism 110 and the movement of flags 102 is controlled via a direct drive mechanism by rotation of handle 22 through the sterile handle cover 42. The pattern of light can be changed by the surgeon during a procedure. In a number of prior devices, control of pattern size for surgical lights is achieved by remote control devices operated by a person other than the surgeon, preferably outside of the surgical field.

The detailed description of mechanism 110 is disclosed in the co-pending, commonly owned patent application of Gehly et al. for "Pattern Change Mechanism" filed simultaneously herewith, the complete disclosure of which is hereby incorporated herein by reference. Briefly, however, the mechanism 110 includes the following items.

The pattern change mechanism is controlled as stated above by the handle 22 through cover 42 at the center of lighting fixture 10, and thus is accessible by the main user, the surgeon. The eight blocking flags 102 are positioned by the top casting 112 and the bottom plate 114. The flags 102 are injection molded Ultem® plastic for excellent dimensional stability, thin profile, ease of manufacture, tight tolerances, and low cost. A small oilite bearing 116 assures smooth rotation.

The handle 22 is attached to the rotation plate 118 through support rods. The rotation plate 118 is located and given smooth motion through three vee-bearings 120 which ride on a special fixed track 122. This system ensures smooth rotation of the rotation plate 118. The handle 22 rotates a total of 60° to move from the large pattern, through the medium pattern, to the small pattern.

The rotation of the rotation plate 118, turns the flags 102 through a synchronized drive mechanism. Two drive actuators 124 are attached to the rotation plate 118 through a special bushing 126. The two drive actuators 124 each have a flag 102 attached. The drive actuators 124 feed through an actuator arm 130 which is free to ride in a groove in the rotation plate 118. Each remaining flag 102 is attached to an actuator guide 132 with its corresponding actuator arm 130. Finally, each actuator arm 130 is linked together (subsequently, all eight flags) through a link plate 134. The action then works as such: rotation of the handle 22 causes rotation of the rotation plate 118. Turning rotation plate 118 causes the drive actuators 124 to move and thus, moves the six other actuator guides 132 by virtue of their operative linkage through the link plate 134. Movement of the actuators causes the blocking flags 102 to rotate so that they are positioned at an angle relative to the lines of intersection 104, thereby blocking light directed away from reflector 14 from passing through areas of refractor 18, specifically, one or both of the first and second sets of prisms 48, 50. Vee-bearings 120 which ride on track 122 define the degree to which rotation plate 118 can rotate. A rotation of 60° from the large to the small pattern is preferred.

Specific stops and a detent position for the three pattern sizes are accomplished by any suitable known means, such as a spring plunger mounted in the track 122, and engaging a recess located in the rotation plate 118.

The cooperation between pattern change mechanism 110 and refractor 18 provides a unique optical system which permits easy control of multiple pattern sizes without the loss of optical performance typical of prior art lighting systems.

What is claimed is:

1. A lighting fixture to illuminate a target surface comprising:

light source means for emitting light;

reflector means superposing said light source means in a partially circumscribing radially spaced relationship about an axis of symmetry of the lighting fixture for receiving the light emitted from the said light source means and directing such received light away from said reflector means towards a target surface;

refractor means positioned beneath said reflector means through which the light directed away from said reflector means passes before proceeding towards said target surface, said refractor means being comprised of a plurality of at least first and second refractive prism means for focusing the light passed therethrough, said first prism means being configured to focus the light to define a cylinder of light coaxial to said axis of symmetry having a first desired diameter and beginning at a desired distance from said refractor means and extending for a length within the total depth of field, and second prism means being configured to focus the light to increase the outer diameter of said cylinder of light to a second desired diameter without altering the illuminance intensity and without significantly changing the length of said cylinder of light;

wherein the light is directed away from said reflector means and passes through said first and second prism means in such a manner that substantially all of the light defining said first and second desired diameters of said cylinder of light does not cross said axis of symmetry.

2. The lighting fixture recited in claim 1 further comprising a cylindrical filter arranged circumferentially around said axis of symmetry through which light from said light source means passes to said reflector means.

3. The lighting fixture recited in claim 2 wherein said cylindrical filter is made of a material to absorb heat.

4. The lighting fixture recited in claim 2 wherein said cylindrical filter is configured to permit heat from said light source means to flow in a direction away from said refractor means such that heat is directed away from said target surface.

5. The lighting fixture recited in claim 2 wherein said cylindrical filter is coated on its interior surface with a dichroic coating to absorb heat emitted from said light source means.

6. The lighting fixture recited in claim 1 further comprising means for selectively blocking light from passing through said second prism means to confine said cylinder of light to said first desired diameter.

7. The lighting fixture recited in claim 1 wherein said refractor means further comprises a plurality of third prism means being configured to focus the light to increase the outer diameter of said cylinder of light relative to said second desired diameter to a third desired diameter without altering the illuminance intensity and without significantly changing the length of said cylinder of light, wherein the light is directed away from said reflector and passes through said third prism means in a manner such that substantially all of the light defining said third desired diameter of said cylinder of light does not cross said axis of symmetry.

8. The lighting fixture recited in claim 7 further comprising means for selectively blocking the passage of light through said refractor means, said blocking means being movable in gradual degrees to a first position in which the light passing through said first, second and third prism means is not blocked to permit said cylinder of light to assume said third desired diameter, and is movable in gradual degrees to a second position in which the light passing through said third prism means is gradually blocked to gradually reduced the diameter of said cylinder of light from said third desired diameter to confine said cylinder of light to said second desired diameter, and is movable in gradual degrees to a third position in which the light passing through said second and third prism means is gradually blocked to gradually reduce the diameter of said cylinder of light from said second desired diameter to confine said cylinder of light to said first desired diameter.

9. The lighting fixture recited in claim 1 wherein said refractor means is divided into a plurality of substantially equal adjacent portions which radiate outwardly from said axis of symmetry, each said portion being comprised of said at least first and second prism means such that light passing through said plurality of first and second prism means of said plurality of portions is mixed to achieve a blended pattern of light when said cylinder of light impinges said target surface.

10. The lighting fixture recited in claim 9 wherein each said portion further comprises a plurality of third prism means configured to focus light to increase the outer diameter of said cylinder of light relative to said second diameter to a third desired diameter without altering the illuminance intensity and without significantly changing the length of said cylinder of light.

11. The lighting fixture recited in claim 10 wherein said plurality of first, second and third prism means are positioned in predetermined areas of each said portion to specifically focus the light passing therethrough to specific areas within said first, second and third diameters, respectively, of said cylinder of light.

12. The lighting fixture recited in claim 11 wherein there are eight said portions in the shape of wedges.

13. The lighting fixture recited in claim 11 wherein said plurality of first prism means is comprised of a plurality of different segments, each said segment focusing the light to a different area within said first desired diameter of said cylinder of light.

14. The lighting fixture recited in claim 13 wherein there are ten said different segments and each of said ten segments is comprised of a plurality of individual prism members.

15. The lighting fixture recited in claim 10 wherein each of said plurality of first, second and third prism means is comprised of a plurality of individual prism members of varying configuration.

16. The lighting fixture recited in claim 15 wherein each portion of said refractor means is comprised of about 806 of said individual prism members.

17. The lighting fixture recited in claim 1 wherein said at least first and second prism means are each comprised of a plurality of individual prism members of varying configuration.

18. The lighting fixture recited in claim 1 wherein said plurality of first prism means further comprise a plurality of different segments each of which focus the light to a different area within said first desired diameter of said cylinder of light.

19. The lighting fixture recited in claim 1 wherein said reflector means is configured to direct the light in a collimated manner onto said refractor means.

20. The lighting fixture recited in claim 1 wherein said reflector means is coated on its interior surface with a reflective material for absorbing a selected portion of the visible light spectrum to correct the color to a predetermined color temperature.

21. The lighting fixture recited in claim 20 wherein said reflective material is a color correcting cold-mirror type dichroic film.

22. The lighting fixture recited in claim 20 wherein said predetermined corrected color temperature is about 4200° K.

23. The lighting fixture recited in claim 1 wherein said light source means is a single lamp positioned at the focal point of said reflector means.

24. A refractor for use in a lighting fixture having a light source and a reflector superposing and partially circumscribing the light source in a radially spaced relationship relative to an axis of symmetry of the lighting fixture for receiving light from the light source and directing such light towards a target surface, said refractor comprising:

a plurality of at least first and second refractive prism means for focusing light passed therethrough, said first prism means being configured to focus the light to define a cylinder of light coaxial to an axis of symmetry of a lighting fixture from which the light originates having a first desired diameter and beginning at a desired distance from the refractor and extending for a length within the total depth of field, and second prism means being configured to focus the light to increase the outer diameter of said cylinder of light to a second desired diameter without altering the illuminance intensity and without significantly changing the length of said cylinder of light.

25. The refractor recited in claim 24 further comprising plurality of third prism means being configured to focus the light to increase the outer diameter of said cylinder of light relative to said second desired diameter to a third desired diameter without altering the illuminance intensity and without significantly changing the length of said cylinder of light, such that wherein the light is directed away from said reflector and passes through said third prism means in a manner such that substantially all of the light defining said third desired diameter of said cylinder of light does not cross said axis of symmetry.

26. The refractor recited in claim 25 wherein each of said plurality of first, second and third prism means is comprised of a plurality of individual prism members of varying configuration.

27. The refractor recited in claim 24 wherein said refractor is divided into a plurality of substantially equal adjacent portions which radiate outwardly from said axis of symmetry, each said portion being comprised of said at least first and second prism means such that light passing through said plurality of first and second prism means of said plurality of portions is mixed to achieve a blended pattern of light when said cylinder of light impinges said target surface.

28. The refractor recited in claim 27 wherein each said portion further comprises a plurality of third prism means configured to focus light to increase the outer diameter of said cylinder of light relative to said second diameter to a third desired diameter without altering the illuminance intensity and without significantly changing the length of said cylinder of light.

29. The refractor recited in claim 28 wherein said plurality of first, second and third prism means are positioned in predetermined areas of each said portion to specifically focus the light passing therethrough to specific areas within said first, second and third diameters, respectively, of said cylinder of light.

30. The refractor recited in claim 29 wherein there are eight said portions in the shape of wedges.

31. The refractor recited in claim 30 wherein said plurality of first prism means is comprised of a plurality of different segments, each said segment focusing the light to a different area within said first desired diameter of said cylinder of light.

32. The refractor recited in claim 31 wherein there are ten said different segments and each of said ten segments is comprised of a plurality of individual prism members.

* * * * *

UNITED STATES PATENT AND TRADEMARK OFFICE

CERTIFICATE OF CORRECTION

PATENT NO. : 5,001,616

DATED : March 19, 1991

INVENTOR(S) : Joel C. Gehly and A. Michael Smith

It is certified that error appears in the above-identified patent and that said Letters Patent is hereby corrected as shown below:

Col. 1, line 43, delete "The" and substitute therefor --To--.

Col. 3, line 34, delete "reduced" and substitute therefor --reduce--.

Col. 3, line 39, delete "reduced" and substitute therefor --reduce--.

Col. 3, line 41, after "diameter" insert --.--.

Col. 4, line 22, delete "preferable" and substitute therefor --preferably--.

Col. 4, line 31, delete "preferable" and substitute therefor --preferably--.

Col. 6, line 47, delete "know" and substitute therefor --known--.

Col. 7, line 35, delete "member" and substitute therefor --members--.

Col. 10, line 15, delete "reduced" and substitute therefor --reduce--.

UNITED STATES PATENT AND TRADEMARK OFFICE

CERTIFICATE OF CORRECTION

PATENT NO. : 5,001,616

DATED : March 19, 1991

INVENTOR(S) : Joel C. Gehly and A. Michael Smith

It is certified that error appears in the above-identified patent and that said Letters Patent is hereby corrected as shown below:

Col. 4, line 44, delete "Schott" and substitute therefor --Scholt--.

Signed and Sealed this

Twenty-second Day of September, 1992

*Attest:*

DOUGLAS B. COMER

*Attesting Officer*

*Acting Commissioner of Patents and Trademarks*